US006079249A

United States Patent [19]

Turner et al.

[11] Patent Number: 6,079,249

[45] Date of Patent: Jun. 27, 2000

[54] METHODS AND APPARATUS FOR FORMING A BEADED CAN END

[75] Inventors: Stephen B. Turner, Kettering; Carl W. Hoying, Springboro, both of Ohio

[73] Assignee: Alfons Haar Inc., Miamisburg, Ohio

[21] Appl. No.: 09/184,605

[22] Filed: Nov. 2, 1998

[51] Int. Cl.[7] ..... B21D 51/44

[52] U.S. Cl. ..... 72/329; 72/348

[58] Field of Search ..... 72/327, 328, 329, 72/348

[56] References Cited

U.S. PATENT DOCUMENTS

| | | | |
|---|---|---|---|
| 4,571,978 | 2/1986 | Taube et al. . | |
| 4,587,825 | 5/1986 | Bulso, Jr. et al. . | |
| 4,808,052 | 2/1989 | Bulso, Jr. et al. . | |
| 4,862,722 | 9/1989 | Fraze et al. . | |
| 4,903,521 | 2/1990 | Bulso, Jr. et al. . | |
| 4,977,772 | 12/1990 | Bulso, Jr. et al. . | |
| 5,024,077 | 6/1991 | Bulso, Jr. et al. | 72/348 |
| 5,042,284 | 8/1991 | Stodd et al. . | |
| 5,062,287 | 11/1991 | Brown et al. . | |
| 5,309,749 | 5/1994 | Stodd . | |
| 5,331,836 | 7/1994 | Cudzik . | |
| 5,381,683 | 1/1995 | Cowling . | |
| 5,442,947 | 8/1995 | Stodd . | |
| 5,502,995 | 4/1996 | Stodd . | |
| 5,823,040 | 10/1998 | Stodd | 72/348 |

FOREIGN PATENT DOCUMENTS 0 518 613 A1 12/1992 European Pat. Off. .

OTHER PUBLICATIONS

The Canmaker, Nov. 1990.

*Primary Examiner*—Lowell A. Larson
*Attorney, Agent, or Firm*—Killworth, Gottman, Hagan & Schaeff, LLP

[57] ABSTRACT

A can end is formed from sheet material in a single acting press by blanking a workpiece and holding the workpiece between a blanking punch and a draw pad. The periphery of the workpiece is worked between a knockout and a crown ring to contour a crown. A bead punch advances into the workpiece to form a shell extending from the crown. The bead punch bottoms out on a bead die and collapses to a predetermined position to form a plurality of beads adjacent the shell by flowing a portion of the shell to form the beads while shortening the shell to less than specifications for the can end. The bead punch returns to an uncollapsed position during upstroke of the press to extend the shell to be within specifications. Apparatus for forming a can end in a press includes a fluidly supported die crown ring having an upper surface defining a can end crown contour. A knockout is aligned with the die crown ring for engaging a workpiece upon downstroke of the press to form a crown in the periphery of the workpiece. A punch, mounted to collapse against fluid pressure, forms a shell extending from the crown and presses the workpiece against a bead die to form a plurality of beads adjacent the shell. The punch collapses so that a portion of the shell flows to form the beads and returns to an uncollapsed position during upstroke to extend the shell to meet specifications.

12 Claims, 4 Drawing Sheets

METHODS AND APPARATUS FOR FORMING A BEADED CAN END

BACKGROUND OF THE INVENTION

This invention relates in general to forming end panels for containers, commonly referred to as cans, and, more particularly, to methods and apparatus for forming can ends from thin sheet material in a single acting press with the can ends having at least one and preferably a plurality of beads formed without unacceptable thinning by flowing material from a shell which is thereby reduced in length resulting in a shortened shell length which is extended during the upstroke of the press to be within required specifications for the can ends.

Ends for closing cans, such as cans for containing foods, are well known in the art. Such can ends are normally made of steel and are formed with concentric beads which permit some flexing of the can ends when secured to can bodies to accommodate pressure changes associated with processing foods within the cans. Conventional can ends include, for example, three beads formed near a crown of the can end with which the can end is secured to the can body. These can ends can be made by blanking a workpiece from a sheet of steel, drawing the workpiece to generate a shallow cup with a crown, and forming the beads between male and female profiled tools which penetrate one another.

Simultaneously drawing the material over each bead profile can result in significant stretching or thinning of the material and coatings on the material, particularly at locations entering a bead. Such thinning of the material around beads of can ends can lead to nonuniform stresses within the material leading to warping or twisting of the can ends, fractures within the bead areas which can lead to "leakers", and cracks in enamel coatings applied to the material to prevent direct contact of the material of the can ends with food contained within cans.

These problems are exacerbated as the canning industry continues to pursue the use of thinner and thinner stock material for making can ends. In this regard, there have been recent efforts to use double reduced steel for making can ends. With such reduced thickness materials, panel fractures also can occur since the material is so thin and is more work hardened. Further, an increased amount of force is required to form the can ends and double reduced steel displays a significant amount of memory leading to spring back which can result in warping and shallow beads in addition to the thinning problems.

There is, thus, a need for improved methods and apparatus for forming beaded can ends from thin sheet materials, such as double reduced steel, which overcome the problems currently being encountered in the art. Preferably, the improved methods and apparatus would employ a single acting press having a fixed base and a movable upper punch assembly.

SUMMARY OF THE INVENTION

This need is met by the methods and apparatus of the present application wherein a shell interconnecting a crown and a central portion of a blanked workpiece is initially formed and then flowed to beads adjacent the shell as the beads are formed so that the beads are not overly stretched or thinned. During bead formation, the shell is reduced in length with the resulting shortened shell length being extended during upstroke of the press to be within required specifications for can ends being produced.

In accordance with one aspect of the present invention, a method for forming a can end from a sheet of material in a single acting press having a fixed base and a movable upper punch assembly comprises blanking a workpiece from the sheet of material and holding the workpiece between a blanking punch carried by the punch assembly and a draw pad carried by the base. A peripheral portion of the workpiece is worked between a knockout carried by the punch assembly and a crown ring carried by the base to contour a crown in the peripheral portion of the workpiece. A bead punch carried by the punch assembly is advanced into the workpiece to form a shell extending from the crown to a central portion of the workpiece. The bead punch is controlled to form at least one bead adjacent the shell by flowing a portion of the shell to form the at least one bead and shorten the shell depth to a length which is less than specifications for the can end. To restore the shell to required can end specifications, the shell is extended during upstroke of the press.

The step of controlling the bead punch may comprise the steps of advancing the bead punch to a bottomed out position on a bead die carried by the base, and collapsing the bead punch to a predetermined position. The step of extending the shell to be within the specifications for the can end during upstroke of the press may comprise the steps of maintaining the bead punch in the bottomed out position for a dwell period, and moving the knockout and the crown ring relative to the bead punch during the dwell period. The step of controlling the bead punch preferably comprises controlling the bead punch to form a plurality of beads adjacent the shell by flowing a portion of the shell and shortening the shell depth to a length which is less than specifications for the can end. For a working embodiment of the invention, the step of controlling the bead punch comprises controlling the bead punch to form a plurality of beads adjacent the shell while shortening the shell depth from 0.120 inch to 0.105 inch and flowing a portion of the shell into the at least one bead.

In accordance with another aspect of the present invention, a method for forming a can end from a sheet of material in a single acting press having a fixed base and a movable upper punch assembly comprises initially blanking a workpiece from the sheet of material. The workpiece is then held between a blanking punch carried by the punch assembly and a draw pad carried by the base. A peripheral portion of the workpiece is worked between a knockout carried by the punch assembly and a crown ring carried by the base to contour a crown in the peripheral portion of the workpiece. A bead punch is advanced into the workpiece to form a shell extending from the crown to a central portion of the workpiece and to engage the workpiece with a bead die carried by the base. The bead punch is further advanced into the workpiece and the bead die to form at least one bead adjacent the shell. The bead punch is collapsed to a predetermined position to permit a portion of the shell to flow into the at least one bead thereby reducing the depth of the shell to a length which is less than specifications for the can end. The bead punch is returned to an uncollapsed position to extend the shell to be within the specifications for the can end during upstroke of the press.

In accordance with still another aspect of the present invention, a method for forming a can end from a sheet of material in a single acting press having a fixed base and a movable upper punch assembly comprises forming a cup having a central portion, a crown and a shell extending between the crown and the central portion. A plurality of beads are formed adjacent the shell by clamping the central portion of the cup between a bead punch carried by the punch assembly and a bead die carried by the base with a portion of the material for forming the plurality of beads flowing from the shell and reducing the depth of the shell to be less than specifications for the can end. The shell is extended to be within the specifications for the can end during upstroke of the press. The step of forming a plurality of beads adjacent the shell may comprise advancing the bead punch to bottom out on the bead die, and collapsing the bead punch to a predetermined position. And, the step of extending the shell to be within the specifications for the can end during upstroke of the press may comprise returning the bead punch to an uncollapsed position.

In accordance with yet another aspect of the present invention, apparatus for forming a can end from a sheet of material in a single acting press having a fixed base and a movable upper punch assembly comprises a die crown ring fluidly supported on the fixed base and having an upper surface defining a contour for a crown of the can end. A knockout is carried by the upper punch assembly and is aligned with the die crown ring for engaging a workpiece upon movement of the upper punch assembly toward the fixed base to form a crown in a peripheral portion of the workpiece. A bead punch, carried by the upper punch assembly, forms a shell extending between the crown and a central portion of the workpiece and presses the workpiece against a bead die to form at least one bead adjacent the shell. The bead die is mounted within the upper punch assembly for collapse to a predetermined position relative to the upper punch assembly as the single acting press reaches bottom dead center so that a portion of the shell flows into the at least one bead thereby reducing the depth of the shell to less than the specifications for the can end. The bead die returns to an uncollapsed position during upstroke of the press to extend the shell to be within the specifications for the can end. Preferably, the bead punch is fluidly mounted within the upper punch assembly for collapse of the bead punch and the knockout is biased toward the fixed base by spring biased pressure pin assemblies in the upper punch assembly.

It is, thus, an object of the present invention to provide improved methods and apparatus for forming beaded can ends from thin sheet materials; to provide improved methods and apparatus for forming beaded can ends from thin sheet materials wherein a shell is initially formed, shortened below specifications by flowing a portion of shell material to beads as the beads are formed and extended to be within specifications during upstroke of a press forming the can ends; and, to provide improved methods and apparatus for forming beaded can ends from thin sheet materials in a single acting press wherein a shell is initially formed with the shell being shortened below specifications when a portion of the shell is flowed to beads as the beads are formed by collapsing a bead punch to a predetermined position during formation of the beads, return of the bead punch to an uncollapsed position extends the shell to be within specifications.

Other objects and advantages of the invention will be apparent from the following description, the accompanying drawings and the appended claims.

DETAILED DESCRIPTION OF THE INVENTION

Figure 1:
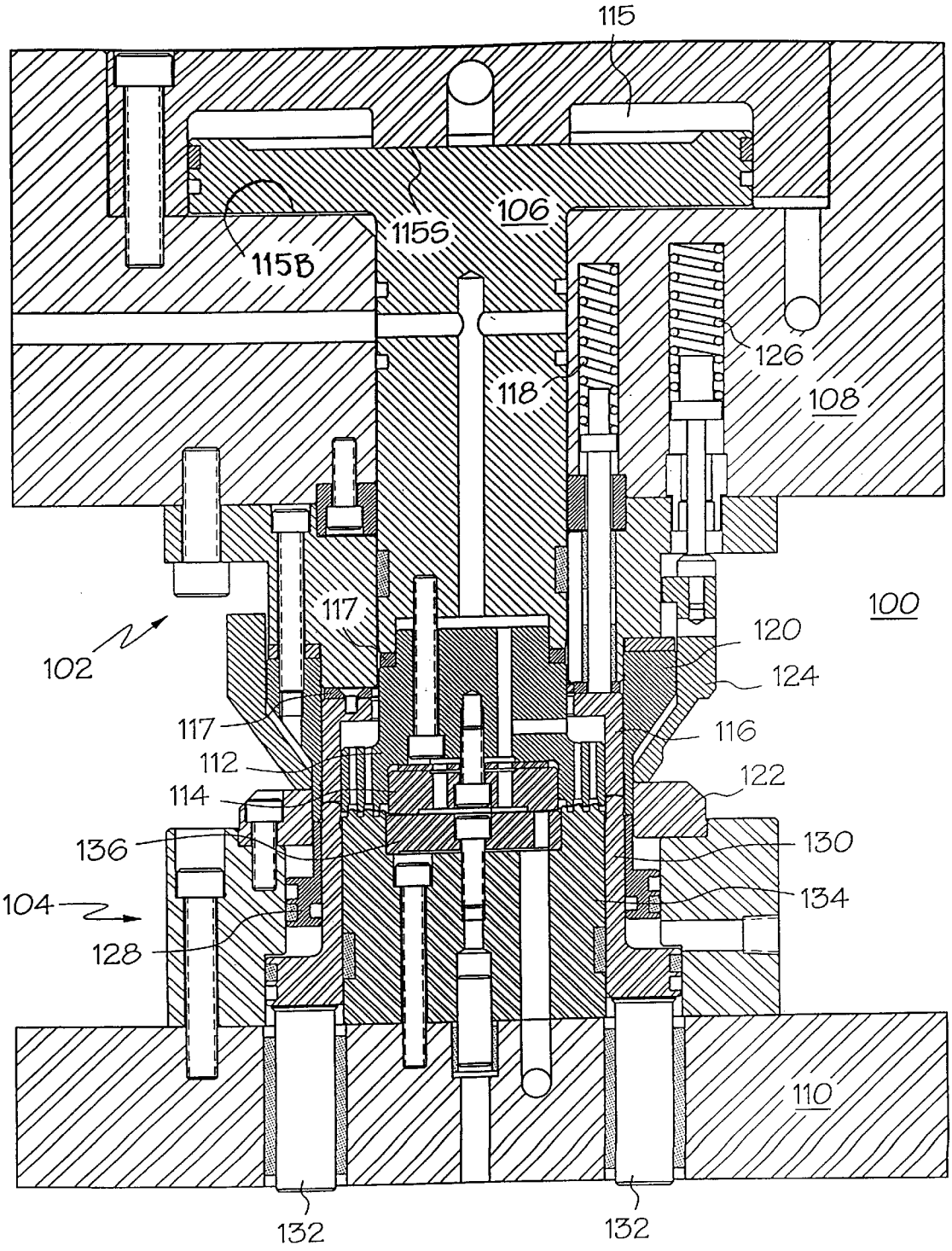
FIG. 1 is a partially sectioned side view of apparatus in accordance with the present invention with a single acting press shown at bottom dead center.

For a description of the methods and apparatus of the invention of the present application, reference will now be made to FIG. 1 which illustrates tooling for use in a single acting press 100 having a movable upper punch assembly 102 and a fixed base 104. The upper punch assembly 102 includes a punch piston 106 mounted in an upper die shoe 108 while the fixed base 104 includes a lower die shoe 110. A bead punch 112 is secured to the punch piston 106 with a bead punch insert 114 secured in the bead punch 112. The bottom surface of the bead punch 112 and the bead punch insert 114 are contoured to impart bead and can end structure to a workpiece W, see FIGS. 2–8, which is blanked from a sheet of material.

The invention of the present application is initially being used to form can ends from double reduced steel sheet material having a thickness around 0.15 mm; however, the invention is generally applicable for use with a wide variety of materials including, among others, aluminum and single reduced steel. The workpiece W is commonly circular; however, it can take a variety of geometric shapes including elliptical, rectangular, square, etc., depending on the shape of the can end to be formed. Also, as should be apparent, can ends produced using the present invention can be used for closing containers or cans not only formed in a variety of shapes but also formed of a variety of materials. While such cans are commonly made of metals, the can ends of the present invention can also be used to close containers made of fibers, plastics and other materials. While use of can ends on cans containing food has been mentioned above, the can ends of the present application also can be used on cans containing beverages, as well as a large variety of other dry and liquid products.

In FIG. 1, the press 100 is shown at bottom dead center and the punch piston 106 is shown in a collapsed position having retracted into the upper punch assembly 102 against pneumatic force in a pressure chamber 115. The collapse of the punch piston 106 into the upper punch assembly 102 is to a predetermined position defined by a stop 115S in the pressure chamber 115. Depending on the particular can end being formed, the predetermined position and amount of collapse can be determined by selection of the stop 115S and hard spacers 117 within the upper punch assembly 102. As will be apparent to those skilled in the art, the upper punch assembly 102 includes a variety of passageways for venting and applying compressed air or vacuum within the upper punch assembly 102.

The upper punch assembly 102 also includes a knockout ring or knockout 116 which is supported and downwardly biased by a series of spring loaded pressure pin assemblies 118 (only one shown). As shown in FIG. 1, the knockout 116 is bottomed out against the upper punch assembly 102. A blank punch 120 enters into an annular cutedge 122 secured to the lower die shoe 110 of the fixed base 102 to blank out a workpiece W of metal. A stripper ring or stripper 124, which is supported and downwardly biased by a series of spring loaded pressure pin assemblies 126 (only one shown), holds the sheet of material adjacent the workpiece W for blanking.

An annular draw pad 128, supported in the fixed base 104 by an air cushion, is positioned opposite the blank punch 120 for clamping the workpiece W between the blank punch 120 and the draw pad 128 during processing of the workpiece W. An annular crown ring 130 is supported in the fixed base 104 on a series of air supported pressure pins 132 (two shown). The upper surface of the crown ring 130 is shaped to contour the crown C of the can end which is formed from the workpiece W and positioned opposite the knockout 116. A bead die 134 is secured to the lower die shoe 110 of the fixed base 102 with a bead die insert 136 secured in the bead die 134. The bead die 134 and bead die insert 136 mate with the bead punch 112 and the bead punch insert 114 to form the can end from the blanked workpiece W.

Figure 2:
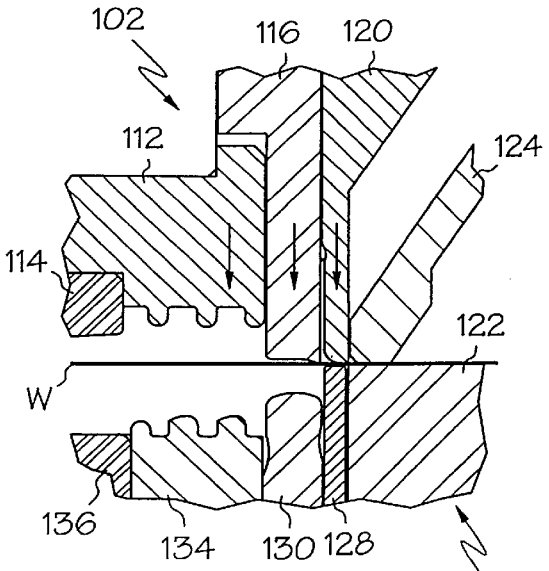
FIG. 2 is an enlarged, partially sectioned side view showing portions of the apparatus of FIG. 1 immediately prior to blanking.

Reference will now be made to FIGS. 2 through 8 which illustrate operation of the apparatus of the invention of the present application in accordance with methods of the invention of the present application. In FIG. 2, the upper punch assembly 102 has traveled downward until the stripper 124, the blank punch 120 and the knockout 116 are in contact with the sheet of material from which the workpiece W is to be blanked. At this time, the stripper 124 clamps the sheet of material against the cutedge 122 and enters a dwell period. Also, the blank punch 120 begins to shear the sheet of material against the cutedge 122 to form the workpiece W.

Figure 3:
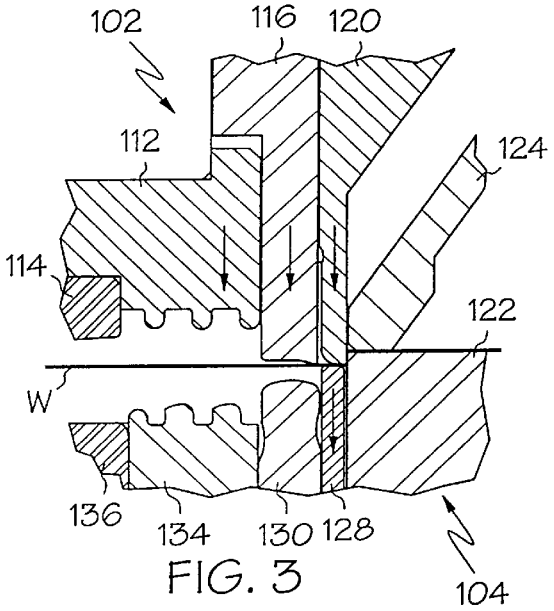
FIG. 3 is an enlarged, partially sectioned side view showing portions of the apparatus of FIG. 1 after blanking with the outer edge of the workpiece clamped between a blank punch and a draw pad.
Figure 4:
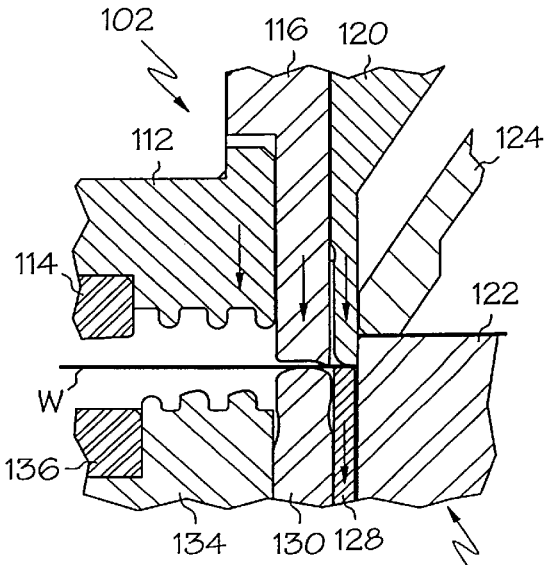
FIG. 4 is an enlarged, partially sectioned side view showing portions of the apparatus of FIG. 1 wherein the workpiece makes initial contact with a crown ring.
Figure 5:
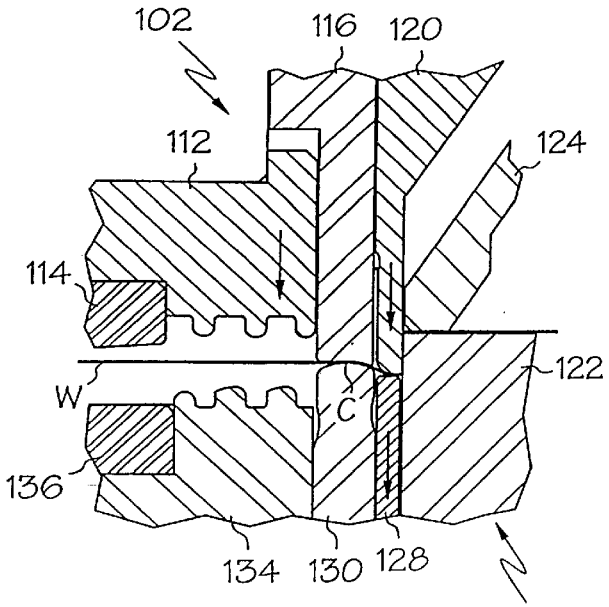
FIG. 5 is an enlarged, partially sectioned side view showing portions of the apparatus of FIG. 1 wherein the material is being formed to the contour of the crown ring by a knockout ring.

In FIG. 3, the peripheral edge of the workpiece W becomes clamped between the blank punch 120 and the draw pad 128 which both travel downward along with the knockout 116, the bead punch 112 and the bead punch insert 114. In FIG. 4, the peripheral edge of the workpiece W is still clamped between the blank punch 120 and the draw pad 128 and the workpiece W makes first contact with the crown ring 130. In FIG. 5, a peripheral portion of the workpiece W between the knockout 116 and the crown ring 130 is worked to form the contour of the crown C, the upper surface of the crown ring 130 forming the inner contour of the crown C. At this time, the knockout 116 enters a period of dwell while the blank punch 120, the draw pad 128, the bead punch 112 and the bead punch insert 114 continue their downward movement.

Figure 6:
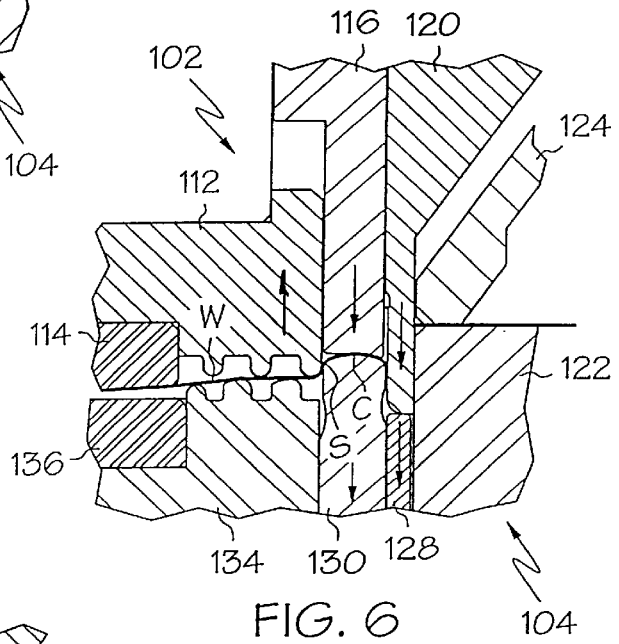
FIG. 6 is an enlarged, partially sectioned side view showing portions of the apparatus of FIG. 1 wherein the crown contour has been completely formed, the knockout has bottomed out on a portion of the upper punch assembly and a bead punch of the upper punch assembly is starting to collapse and reduce the shell length.

In FIG. 6, the geometry of the crown C has been completely formed with the outermost portion of the workpiece W being wiped over the outer edge of the upper surface of the crown ring 130 by the continuing downward motion of the blank punch 120 and the draw pad 128. Also, the shell S is formed at the inner portion of the crown C between the outermost edge of the bead punch 112 and the crown ring 130. At this time, the knockout 116 has bottomed out on the upper punch assembly 102 thus leaving its dwell period and continuing its downward movement together with the crown ring 130. The shell S has now been formed interconnecting the crown C and a central portion of the workpiece W. The punch piston 106 begins to collapse toward the predetermined position defined by the stop 115S and the formation of beads B commences between the bead punch 112 and the bead punch insert 114, and the bead die 134 and bead die insert 136, see FIG. 6. In the invention of the present application, the beads B are formed by flowing a portion of the shell S into the beads B.

Figure 7:
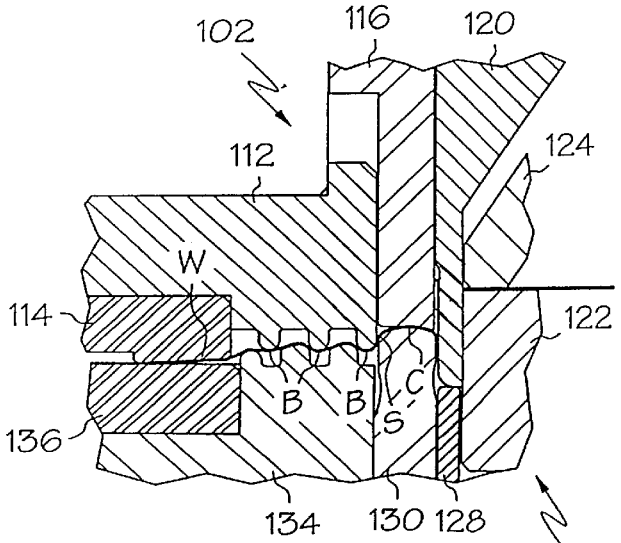
FIG. 7 is an enlarged, partially sectioned side view showing portions of the apparatus of FIG. 1 wherein the press is at bottom dead center with the bead punch of the upper punch assembly collapsed to a predetermined position to enable excess material in the shell to flow into beads being formed in the workpiece resulting in a shortened shell length.

In FIG. 7, the press 100 is at bottom dead center, the bead punch 112 and the bead punch insert 114 have collapsed due to the collapse of the punch piston 106 against the pneumatic force in a pressure chamber 115 to the predetermined position defined by the stop 115S, i.e., the piston 106 has moved from an uncollapsed position against the bottom 115B of the pressure chamber 115 to a collapsed position against the stop 115S. This control and collapse of the bead punch 112, bead punch insert 114 and punch piston 106 to the predetermined position form at least one bead adjacent the shell S while shortening the shell S to a length which is shorter than the specifications for the can end being formed from the workpiece W. For example, for one can end with specifications that call for a shell length of 0.120 inch, the shell may be shortened to around 0.105 inch during formation of the beads B. As shown in FIG. 7, the bead punch 112 and bead punch insert 114 have collapsed upward to the predetermined position defined by engagement of the punch piston 106 with the stop 115S, by approximately 0.015 inch for the noted can end, to enable the material making up the shell S in FIG. 6 to flow into the beads B being formed in the workpiece W.

Figure 8:
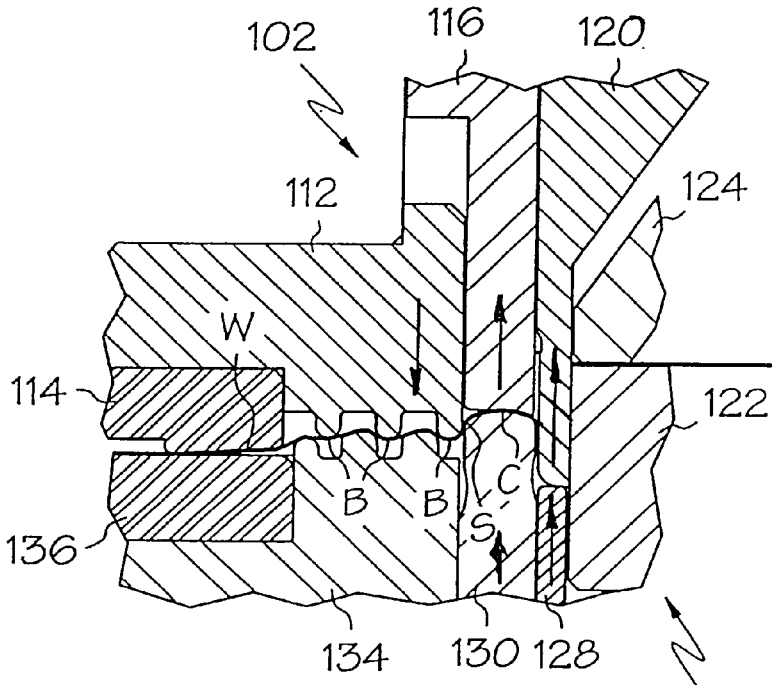
FIG. 8 is an enlarged, partially sectioned side view showing portions of the apparatus of FIG. 1 wherein the press is on its upstroke allowing pneumatic forces to extend the shell such that the shell is within required specifications for can ends being produced.

Formation of the beads B of a can end being formed from the workpiece W has been completed when the press 100 reaches bottom dead center and the shortened shell S at that time does not meet specifications. To correct the length of the shell S, during the upstroke of the press 100, the shell S is extended as a result of the pneumatic pressure in the pressure chamber 115. As the upper punch assembly 102 raises, the punch piston 106, bead punch 112 and bead punch insert 114 enter a period of dwell defined by the time it takes for the punch piston 106 to return to its uncollapsed position from its collapsed position and, hence, the crown ring 130 and knockout 116 move relative to the punch piston 106, bead punch 112 and bead punch insert 114. Thus, during this time, the crown ring 130 and knockout 116 travel upward but the bead punch 112/bead punch insert 114 do not, as shown in FIG. 8, so that the shell S is lengthened by drawing additional material from between the crown ring 130 and the knockout 116.

After formation, the can end is retained inside the blank punch 112 and is transported upward with the upper punch assembly 102. The knockout 116 pushes the can end out of the blank punch 112 with the can end being ejected and carried away. This portion of the processing of the can end is in accordance with known, commercially available handling equipment and, accordingly, will not be described further herein.

For proper operation of the illustrated apparatus of the present invention, the single acting press 100 should provide hydraulic overload protection to compensate for thermal and dynamic over travel in the system. A variety of presses including hydraulic overload protection which can be used are commercially available from Alfons Haar Maschinenbau Gmbh & Co. of Hamburg, Germany. Alternately, compensation for thermal and dynamic over travel can be added to the die tooling as is well known in the art.

Having thus described the invention of the present application in detail and by reference to preferred embodiments thereof, it will be apparent that modifications and variations are possible without departing from the scope of the invention defined in the appended claims.

What is claimed is:

1. A method for forming a can end from a sheet of material in a single acting press having a fixed base and a movable upper punch assembly, said method comprising the steps of:

blanking a workpiece from said sheet of material;

holding said workpiece between a blanking punch carried by said punch assembly and a draw pad carried by said base;

working a peripheral portion of said workpiece between a knockout carried by said punch assembly and a crown ring carried by said base to contour a crown in said peripheral portion of said workpiece;

advancing a bead punch carried by said punch assembly into said workpiece to form a shell extending from said crown to a central portion of said workpiece;

controlling said bead punch to form at least one bead adjacent said shell by flowing a portion of said shell to form said at least one bead and shorten said shell depth to a length which is less than specifications for said can end; and extending said shell to be within said specifications for said can end during upstroke of said press.

2. A method for forming a can end from a sheet of material in a single acting press as claimed in claim 1 wherein said step of controlling said bead punch comprises the steps of:

advancing said bead punch to a bottomed out position on a bead die carried by said base; and collapsing said bead punch to a predetermined position.

3. A method for forming a can end from a sheet of material in a single acting press as claimed in claim 2 wherein said step of extending said shell to be within said specifications for said can end during upstroke of said press comprises the steps of:

maintaining said bead punch in said bottomed out position for a dwell period;

and moving said knockout and said crown ring relative to said bead punch during said dwell period.

4. A method for forming a can end from a sheet of material in a single acting press as claimed in claim 1 wherein said step of controlling said bead punch comprises the step of controlling said bead punch to form a plurality of beads adjacent said shell by flowing a portion of said shell and shortening said shell depth to a length which is less than specifications for said can end.

5. A method for forming a can end from a sheet of material in a single acting press as claimed in claim 1 wherein said step of controlling said bead punch comprises the step of controlling said bead punch to form a plurality of beads adjacent said shell while shortening said depth from 0.120 inch to 0.105 inch and flowing a portion of said shell into said at least one bead.

6. A method for forming a can end from a sheet of material in a single acting press having a fixed base and a movable upper punch assembly, said method comprising the steps of:

blanking a workpiece from said sheet of material;

holding said workpiece between a blanking punch carried by said punch assembly and a draw pad carried by said base;

working a peripheral portion of said workpiece between a knockout carried by said punch assembly and a crown ring carried by said base to contour a crown in said peripheral portion of said workpiece;

advancing a bead punch into said workpiece to form a shell extending from said crown to a central portion of said workpiece and to engage said workpiece with a bead die carried by said base;

further advancing said bead punch into said workpiece and said bead die to form at least one bead adjacent said shell;

collapsing said bead punch to a predetermined position to permit a portion of said shell to flow into said at least one bead thereby reducing said depth of said shell to a length which is less than specifications for said can end; and returning said bead punch to an uncollapsed position to extend said shell to be within said specifications for said can end during upstroke of said press.

7. A method for forming a can end from a sheet of material in a single acting press having a fixed base and a movable upper punch assembly, said method comprising the steps of:

forming a cup having a central portion, a crown and a shell extending between said crown and said central portion;

forming a plurality of beads adjacent said shell by clamping said central portion of said cup between a bead punch carried by said punch assembly and a bead die carried by said base with a portion of the material for forming said plurality of beads flowing from said shell and reducing said depth of said shell to be less than specifications for said can end; and extending said shell to be within said specifications for said can end during upstroke of said press.

8. A method for forming a can end from a sheet of material in a single acting press as claimed in claim 7 wherein said step of forming a plurality of beads adjacent said shell comprises the steps of:

advancing said bead punch to bottom out on said bead die; and collapsing said bead punch to a predetermined position.

9. A method for forming a can end from a sheet of material in a single acting press as claimed in claim 8 wherein said step of extending said shell to be within said specifications for said can end during upstroke of said press comprises the step of returning said bead punch to an uncollapsed position.

10. Apparatus for forming a can end from a sheet of material in a single acting press having a fixed base and a movable upper punch assembly, said apparatus comprising:

a die crown ring fluidly supported on said fixed base and having an upper surface defining a contour for a crown of said can end;

a knockout carried by said upper punch assembly, said knockout being aligned with said die crown ring for engaging a workpiece upon movement of said upper punch assembly toward said fixed base to form a crown in a peripheral portion of said workpiece; and a bead punch carried by said upper punch assembly, said bead punch forming a shell extending between said crown and a central portion of said workpiece, pressing said workpiece against a bead die to form at least one bead adjacent said shell and being mounted within said upper punch assembly for collapse to a predetermined position relative to said upper punch assembly as said single acting press reaches bottom dead center so that a portion of said shell flows into said at least one bead thereby reducing said depth of said shell to less than said specifications for said can end and returning to an uncollapsed position during upstroke of said press to extend said shell to be within said specifications for said can end.

11. Apparatus for forming a can end from a sheet of material in a single acting press as claimed in claim 10 wherein said bead punch is fluidly mounted within said upper punch assembly for collapse of said bead punch.

12. Apparatus for forming a can end from a sheet of material in a single acting press as claimed in claim 11 wherein said knockout is biased toward said fixed base by spring biased pressure pin assemblies in said upper punch assembly.

* * * * *